United States Patent [19]

Richardson, Jr.

[11] Patent Number: 4,875,838

[45] Date of Patent: Oct. 24, 1989

[54] SCROLL COMPRESSOR WITH ORBITING SCROLL MEMBER BIASED BY OIL PRESSURE

[75] Inventor: Hubert Richardson, Jr., Brooklyn, Mich.

[73] Assignee: Tecumseh Products Company, Tecumseh, Mich.

[21] Appl. No.: 193,398

[22] Filed: May 12, 1988

[51] Int. Cl.[4] ..... F04C 18/04; F04C 27/00; F04C 29/02

[52] U.S. Cl. ..... 418/55; 418/88; 418/94

[58] Field of Search ..... 418/55, 57, 88, 94, 418/55 C, 55 D, 55 E

[56] References Cited

U.S. PATENT DOCUMENTS

| | | | |
|---|---|---|---|
| 3,220,350 | 11/1965 | White . | |
| 3,288,073 | 11/1966 | Pezzillo . | |
| 4,234,293 | 11/1980 | Lightle . | |
| 4,357,132 | 11/1982 | Kousokabe | 418/55 |
| 4,365,941 | 12/1982 | Tojo et al. | 418/55 |
| 4,462,772 | 7/1984 | Hazaki et al. | 418/55 |
| 4,473,343 | 9/1984 | Hazaki et al. | 418/55 |
| 4,496,293 | 1/1985 | Nakamura et al. | 417/371 |
| 4,496,296 | 1/1985 | Arai et al. | 418/55 |
| 4,502,852 | 3/1985 | Hazaki | 418/55 |
| 4,522,575 | 6/1985 | Tischer et al. | 418/55 |
| 4,538,975 | 9/1985 | Tsukagoshi | 418/55 |
| 4,551,082 | 11/1985 | Hazaki et al. | 418/55 |
| 4,555,224 | 11/1985 | Hazaki et al. | 418/55 |
| 4,585,403 | 4/1986 | Inaba et al. | 418/55 |
| 4,600,369 | 7/1986 | Blain | 418/55 |
| 4,708,607 | 11/1987 | Hayano et al. | 418/55 |
| 4,743,181 | 5/1988 | Murayama et al. | 418/55 |

FOREIGN PATENT DOCUMENTS

| | | | |
|---|---|---|---|
| 58-160581 | 9/1983 | Japan | 418/55 |
| 58-214692 | 12/1983 | Japan | 418/94 |
| 60-224987 | 11/1985 | Japan | 418/57 |
| 60-228787 | 11/1985 | Japan | 418/57 |
| 61-232396 | 10/1986 | Japan | 418/57 |

*Primary Examiner*—John J. Vrablik

*Attorney, Agent, or Firm*—Albert L. Jeffers; John F. Hoffman; David L. Ahlersmeyer

[57] ABSTRACT

A scroll-type hermetic compressor is disclosed including within a hermetically sealed housing a fixed scroll member, an orbiting scroll member, a main bearing frame member, and a crankshaft. An oil sump is located in a discharge pressure chamber in the housing. The frame member and fixed scroll member define a suction pressure chamber in which the orbiting scroll member is disposed. The crankshaft includes a plate portion disposed between the orbiting scroll member and a thrust surface of the frame. Oil chambers are disposed within respective interfaces between the orbiting scroll member bottom surface and the plate portion top surface, and the plate portion bottom surface and the frame thrust surface. Oil from the oil sump is supplied to the oil chambers. Either a hydrodynamic oil seal or an annular seal element is provided in each interface radially outwardly from the oil chamber.

18 Claims, 7 Drawing Sheets

SCROLL COMPRESSOR WITH ORBITING SCROLL MEMBER BIASED BY OIL PRESSURE

BACKGROUND OF THE INVENTION

The present invention relates generally to a hermetic scroll-type compressor and, more particularly, to such a compressor having intermeshing fixed and orbiting scroll members, wherein it is necessary to provide an axial force on the orbiting scroll member to bias it toward the fixed scroll member for proper sealing therebetween.

A typical scroll compressor comprises two facing scroll members, each having an involute wrap, wherein the respective wraps interfit to define a plurality of closed pockets. When one of the scroll members is orbited relative to the other, the pockets travel between a radially outer suction port and a radially inner discharge port to convey and compress the refrigerant fluid.

It is generally believed that the scroll-type compressor could potentially offer quiet, efficient, and low-maintenance operation in a variety of refrigeration system applications. However, several design problems persist that have prevented the scroll compressor from achieving wide market acceptance and commercial success. For instance, during compressor operation, the pressure of compressed refrigerant at the interface between the scroll members tends to force the scroll members axially apart. Axial separation of the scroll members causes the closed pockets to leak at the interface between the wrap tips of one scroll member and the face surface of the opposite scroll member. Such leakage causes reduced compressor operating efficiency and, in extreme, cases, can result in an inability of the compressor to operate.

Attempts in prior art scroll-type compressors to resist the separating force applied to the scroll members during operation of the compressor, in order to prevent the aforementioned leakage, have not proven to be entirely satisfactory. One approach is to axially preload the scroll members toward each other with a force sufficient to resist the dynamic separating force. However, this approach results in high initial frictional forces between the scroll members and/or bearings when the compressor is at rest, thereby causing difficulty during compressor startup. Another prior art approach involves assuring close manufacturing tolerances for component parts and having the separating force borne by a thrust bearing. This approach not only requires an expensive thrust bearing, but also involves high manufacturing costs in maintaining close machining tolerances.

Another prior art scroll-type compressor design, disclosed in many prior art patents, involves the provision of an intermediate pressure chamber behind the orbiting scroll member, whereby the intermediate pressure creates an upward force to oppose the separating force. Such a design recognizes the fact that suction pressure behind the orbiting scroll member is insufficient to oppose the separating force, while discharge pressure behind the orbiting scroll member results in too great an upward force causing rapid wear of the scroll wraps and faces. However, establishing an intermediate pressure between suction pressure and discharge pressure requires that an intentional leak be introduced between an intermediate pressure pocket and a discharge pressure region. Such a leak results in less efficient operating conditions for the compressor.

Several other prior art scroll compressor designs, directed to controlling the upward force on the orbiting scroll member to oppose the separating force, have utilized a combination of gaseous refrigerant at suction pressure and gaseous refrigerant at discharge pressure for exposure to respective areas on the backside of the orbiting scroll member. In such compressor designs, various seal means have been utilized to separate the respective gas pressure regions. A primary disadvantage of this type of design is the difficulty encountered in sealing between gas regions at different pressures. Consequently, prior art compressors of this general design require elaborate sealing means and closer manufacturing tolerances, thereby increasing the cost of the compressor.

The present invention is directed to overcoming the aforementioned problems associated with scroll-type compressors, wherein it is desired to provide an axial force on the orbiting scroll member to facilitate sealing and prevent leakage between the interfitting scroll members.

SUMMARY OF THE INVENTION

The present invention overcomes the disadvantages of the above-described prior art scroll-type compressors by providing an improved axial compliance mechanism, capable of applying a net axial force on the bottom surface of an orbiting scroll member toward a cooperating fixed scroll member, to resist the tendency of the scroll members to axially separate during compressor operation.

Generally, the invention provides, in one form thereof, a hermetically sealed scroll-type compressor comprising a housing including a discharge pressure chamber and a suction pressure chamber therein. An oil sump is provided within the discharge pressure chamber. A portion of the orbiting scroll member bottom surface is exposed to oil at discharge pressure from the oil sump, while another portion of the bottom surface is exposed to refrigerant fluid at suction pressure within the suction pressure chamber. According to one aspect of the present invention, a radially inner portion of the orbiting scroll member bottom surface is exposed to oil at discharge pressure, while a radially outer portion is exposed to refrigerant fluid at suction pressure. In one form of the invention, an annular seal separates the respective portions exposed to discharge and suction pressure.

More specifically, the invention provides, in one form thereof, a frame member attached to a fixed scroll member within a hermetically sealed housing including a discharge pressure chamber in which an oil sump is located. The fixed scroll member and frame member define a suction pressure chamber in which the orbiting scroll member is disposed. A rotatable crankshaft is provided that includes a shaft portion journalled within the frame member, a crank portion operatively coupled to the orbiting scroll member, and a radially extending plate portion interposed between a bottom surface of the orbiting scroll member and a thrust surface of the frame member. Oil chambers are provided at the respective interfaces between the orbiting scroll member bottom surface and the plate top surface, and between the plate bottom surface and the frame thrust surface. Oil is supplied to the oil chambers from the oil sump by means of an axial oil passageway extending through the crankshaft.

An advantage of the scroll compressor of the present invention is the use of lubricating oil at discharge pressure for axial compliance of the orbiting scroll member toward the fixed scroll member.

Another advantage of the scroll compressor of the present invention is that axial compliance of the orbiting scroll member toward the fixed scroll member is accomplished effectively without excessive leakage between the discharge pressure region and suction pressure region of the compressor.

A further advantage of the scroll compressor of the present invention is the provision of an axial compliance mechanism that is actuated after the compressor starts, thereby avoiding the high frictional forces on start-up associated with some axial compliance mechanisms.

Another advantage of the scroll compressor of the present invention, is the provision of a simple, reliable, inexpensive, and easily manufactured axial compliance mechanism for producing an axial force on the orbiting scroll member toward the fixed scroll member.

A further advantage of the scroll compressor of the present invention is the relative ease with which sealing is accomplished between regions of oil at discharge pressure and refrigerant at suction pressure on the bottom of the orbiting scroll member.

Yet another advantage of the scroll compressor of the present invention is the capability of increasing the net axial force on the orbiting scroll member toward the fixed scroll member while maintaining forces on the crankshaft at substantial equalibrium, thereby avoiding the need for expensive crankshaft thrust bearings.

A still further advantage of the scroll compressor of the present invention is the use of a centrifugal oil pump, rather than a differential pressure oil pump, in connection with the compressor's lubrication system and axial compliance mechanism, whereby clogging of small openings used to control the flow of oil in a differential pressure pumping system by foreign particles in the oil is avoided.

The scroll compressor of the present invention, in one form thereof, provides a hermetically sealed housing including therein a discharge pressure chamber at discharge pressure and a suction pressure chamber at suction pressure. An oil sump is also provided within the discharge pressure chamber. A suction inlet conveys refrigerant fluid from outside of the housing to the suction pressure chamber, while a discharge outlet conveys refrigerant fluid from the discharge pressure chamber to the outside of the housing. A fixed scroll member is provided within the housing and includes an involute fixed wrap element. Also, an orbiting scroll member is provided having a top surface and a bottom surface. The orbiting scroll member includes an involute orbiting wrap element on its top surface. The fixed and orbiting scroll members are generally axially aligned and have an interface therebetween whereat the fixed and orbiting wraps are intermeshed. A radially outer portion of the interface communicates with the suction pressure chamber, and a radially inner portion of the interface communicates with the discharge pressure chamber. The orbiting scroll member is adapted to orbit with respect to the fixed scroll member such that refrigerant entering the interface at the radially outer portion is compressed and subsequently discharged at the radially inner portion. Furthermore, the compressor provides a drive for causing the orbiting scroll to orbit. An axial compliance mechanism applies a net axial force on the bottom surface of the orbiting scroll member toward the fixed scroll member. The axial compliance mechanism exposes respective portions of the bottom surface of the orbiting scroll member to the suction pressure chamber and to oil from the oil sump. The oil from the oil sump is substantially at discharge pressure.

The invention further provides, in one form thereof, a hermetic scroll-type compressor including a hermetically sealed housing having a discharge pressure chamber located therein. An oil sump is included within the discharge pressure chamber. A fixed scroll member having an involute fixed wrap element is also included within the housing. Furthermore, the compressor includes an orbiting scroll member including an involute orbiting wrap element on a top surface thereof. The fixed and orbiting scroll members are intermeshed to define one or more pockets of fluid compressed by relative orbital motion of the fixed and orbiting scroll members. The orbiting scroll member has a bottom surface including a well formed therein. A crankshaft is coupled to the orbiting scroll member to cause the orbiting scroll member to move in orbital relationship relative to the fixed scroll member. The crankshaft has an eccentric crank portion, a shaft portion, and a radially extending plate portion between the crank portion and the shaft portion. The crank portion extends upwardly from a top surface of the plate portion and is journalled for rotation within the well. The bottom surface of the orbiting scroll member and the top surface of the plate portion meet at a substantially planar interface therebetween. The interface originates adjacent the crank portion and extends radially outwardly therefrom. Also provided is a channel within the interface constituting an oil chamber for exposing an area on the orbiting scroll member bottom surface, within the interface, to oil from the oil sump. The channel is located within the interface and originates at a radially innermost portion of the interface and extends radially outwardly therefrom to a radial location within the interface. An oil pump supplies oil from the oil sump to the oil chamber.

The present invention further provides, in one form thereof, a scroll-type compressor for compressing refrigerant including a hermetically sealed housing having therein a discharge pressure chamber. An oil sump is also provided within the discharge pressure chamber. A discharge outlet conveys refrigerant from the discharge pressure chamber to the outside of the housing. A fixed scroll member is mounted within the housing and has a bottom surface including an involute fixed wrap element. The compressor further provides an orbiting scroll member having a top face surface and a bottom surface, the top surface including an involute orbiting wrap element. The fixed and orbiting scroll members cooperatively engage one another to form a plurality of pockets therebetween. The orbiting scroll member is adapted to orbit with respect to the fixed scroll member. A frame is connected within the housing to the fixed scroll member bottom surface, and includes a suction pressure chamber in which the orbiting scroll member is disposed. A suction inlet is provided to convey refrigerant from outside of the housing to the suction pressure chamber. The compressor further includes a rotatable crankshaft having an eccentric crank portion, a shaft portion extending through the frame, and a radially extending plate portion between the crank portion and the shaft portion. The plate portion has a top surface and a bottom surface, and the crank portion operatively engages the orbiting scroll member bottom surface so as to impart orbiting motion thereto. The orbiting scroll member bottom surface is adjacent the plate portion top surface to establish a top interface therebetween. Likewise, a bottom interface is established between the plate portion bottom surface and an adjacent thrust surface of the frame. A top oil chamber is located within the top interface and a bottom oil chamber is located within the bottom interface. Oil is delivered from the oil sump to the top and bottom oil chambers by a pump.

DESCRIPTION OF THE PREFERRED EMBODIMENT

Figure 1:
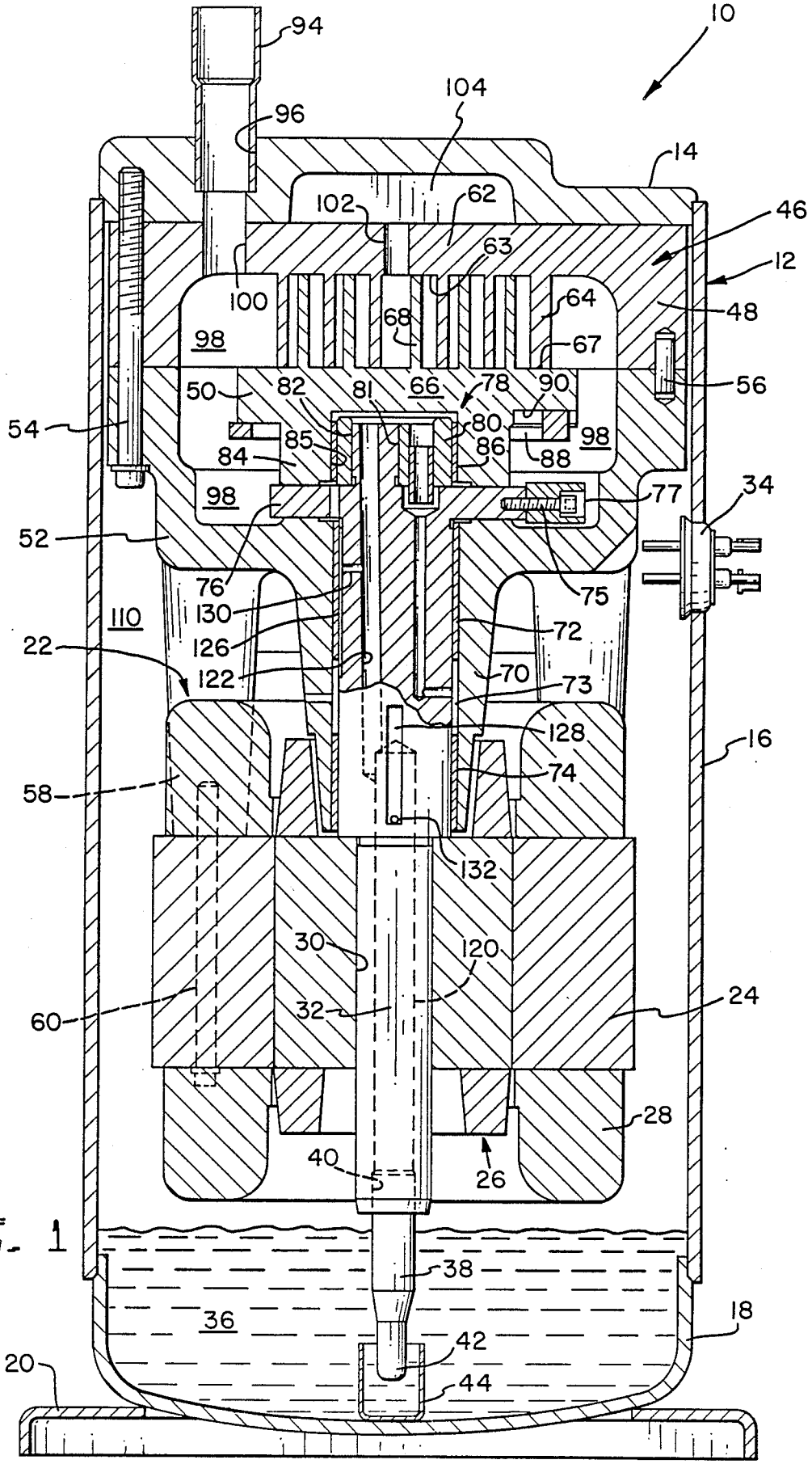
FIG. 1 is a longitudinal sectional view of a compressor of the type to which the present invention pertains, taken along the line 1—1 in FIG. 3 and viewed in the direction of the arrows.
Figure 2:
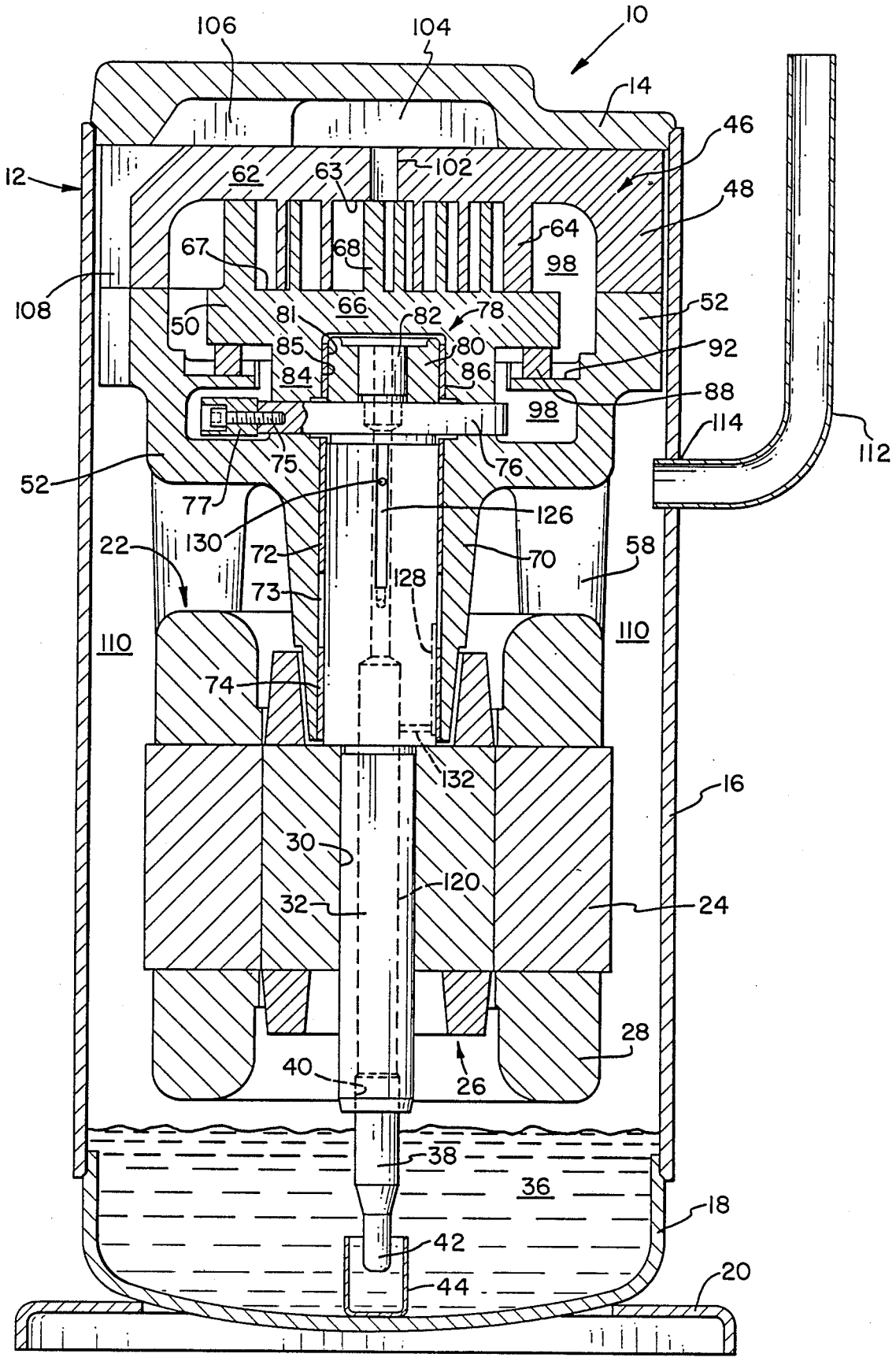
FIG. 2 is a longitudinal sectional view of the compressor of FIG. 1, taken along the line 2—2 in FIG. 3 and viewed in the direction of the arrows.
Figure 3:
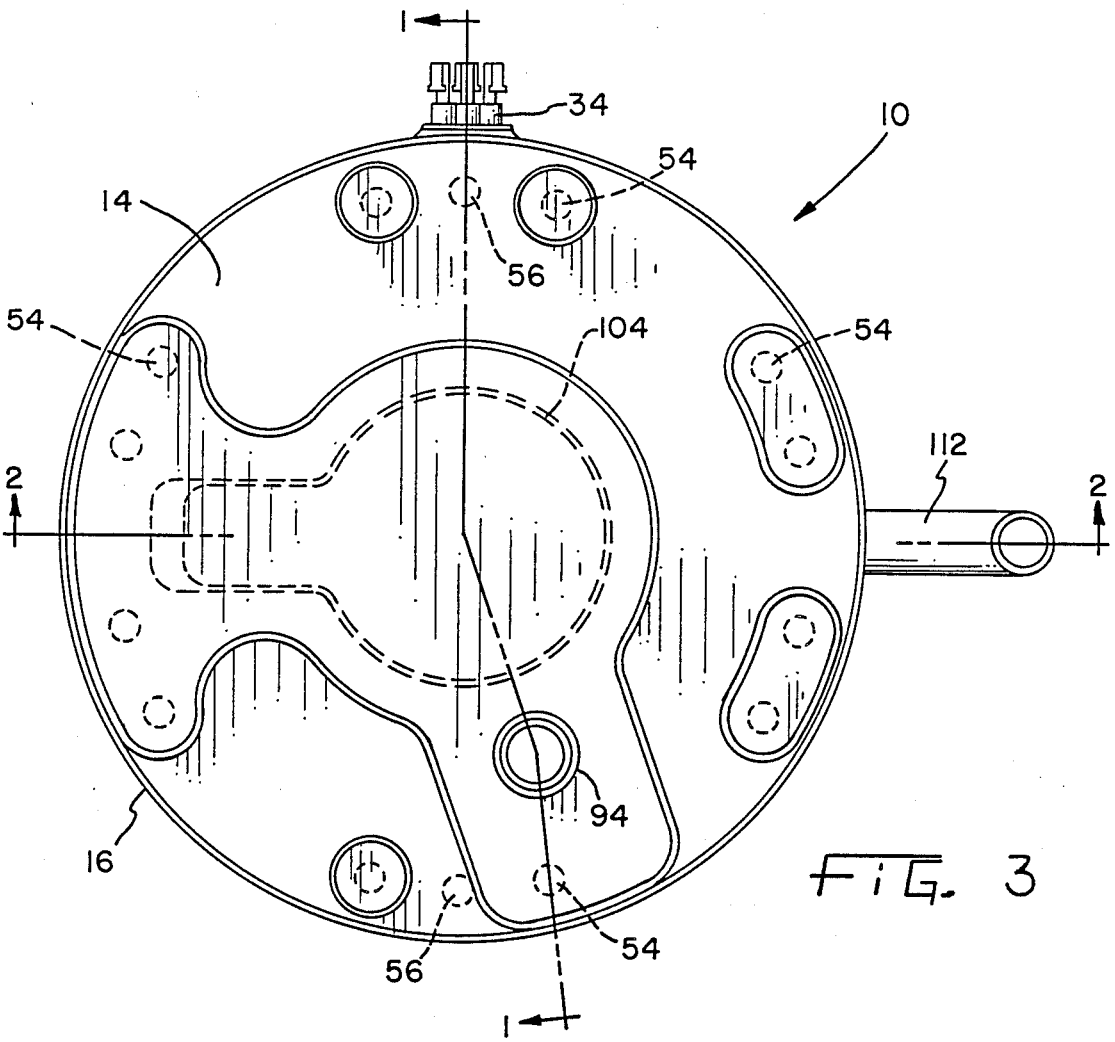
FIG. 3 is an enlarged top view of the compressor of FIG. 1.

In an exemplary embodiment of the invention as shown in the drawings, and in particular by referring to FIGS. 1–3, a compressor 10 is shown having a housing generally designated at 12. The housing has a top cover plate 14, a central portion 16, and a bottom portion 18, wherein central portion 16 and bottom portion 18 may alternatively comprise a unitary shell member. The three housing portions are hermetically secured together as by welding or brazing. A mounting flange 20 is welded to bottom portion 18 for mounting the compressor in a vertically upright position. Located within hermetically sealed housing 12 is an electric motor generally designated at 22, having a stator 24 and a rotor 26. Stator 24 is provided with windings 28. Rotor 26 has a central aperture 30 provided therein into which is secured a crankshaft 32 by an interference fit. A terminal cluster 34 is provided in central portion 16 of housing 12 for connecting motor 22 to a source of electric power.

Compressor 10 also includes an oil sump 36 generally located in bottom portion 18. A centrifugal oil pickup tube 38 is press fit into a counterbore 40 in the lower end of crankshaft 32. Oil pickup tube 38 is of conventional construction and includes a vertical paddle (not shown) enclosed therein. An oil inlet end 42 of pickup tube 38 extends downwardly into the open end of a cylindrical oil cup 44, which provides a quiet zone from which high quality, non-agitated oil is drawn.

Compressor 10 includes a scroll compressor mechanism 46 enclosed within housing 12. Compressor mechanism 46 generally comprises a fixed scroll member 48, an orbiting scroll member 50, and a main bearing frame member 52. As shown in FIG. 1, fixed scroll member 48 and frame member 52 are secured together and are attached to top cover plate 14 by means of a plurality of mounting bolts 54. Precise alignment between fixed scroll member 48 and frame member 52 is accomplished by a pair of locating pins 56. Frame member 52 includes a plurality of mounting pads 58 to which motor stator 24 is attached by means of a plurality of mounting bolts 60, such that there is an annular gap between stator 24 and rotor 26.

Fixed scroll member 48 comprises a generally flat face plate 62 having a face surface 63, and an involute fixed wrap 64 extending axially from surface 63. Likewise, orbiting scroll member 50 comprises a generally flat face plate 66 having a top face surface 67, and an involute orbiting wrap 68 extending axially from surface 67. Fixed scroll member 48 and orbiting scroll member 50 are assembled together so that fixed wrap 64 and orbiting wrap 68 operatively interfit with each other. Furthermore, face surfaces 63, 67 and wraps 64, 68 are manufactured or machined such that, during compressor operation when the fixed and orbiting scroll members are forced axially toward one another, the tips of wraps 64, 68 sealingly engage with respective opposite face surfaces 67, 63.

Main bearing frame member 52, as shown in FIGS. 1 and 2, comprises a downwardly extending bearing portion 70. Retained within bearing portion 70, as by press fitting, is a conventional sleeve bearing assembly comprising an upper bearing 72 and a lower bearing 74. Two sleeve bearings are preferred rather than a single longer sleeve bearing to facilitate easy assembly into bearing portion 70 and to provide an annular space 73 between the two bearings 72, 74. Accordingly, crankshaft 32 is rotatably journalled within bearings 72, 74.

Crankshaft 32 includes a concentric thrust plate 76 extending radially outwardly from the sidewall of crankshaft 32. A balance weight 77 is attached to thrust plate 76, as by bolts 75. Situated on the top of crankshaft 32 is an eccentric crank mechanism 78. According to a preferred embodiment, crank mechanism 78 comprises a cylindrical roller 80 having an axial bore 81 extending therethrough at an off-center location. An eccentric crankpin 82, constituting the upper, offset portion of crankshaft 32, is received within bore 81, whereby roller 80 is eccentrically journalled about eccentric crankpin 82. Orbiting scroll member 50 includes a lower hub portion 84 that defines a cylindrical well 85 into which roller 80 is received. Roller 80 is journalled for rotation within well 85 by means of a sleeve bearing 86, which is press fit into well 85. Each of sleeve bearings 72, 74, and 86 is preferably a steel-backed bronze bushing.

When crankshaft 32 is rotated by motor 22, the operation of eccentric crankpin 82 and roller 80 within well 85 causes orbiting scroll member 50 to orbit with respect to fixed scroll member 48. Roller 80 pivots slightly about crankpin 82 so that crank mechanism 78 functions as a conventional swing-link radial compliance mechanism to promote sealing engagement between fixed wrap 64 and orbiting wrap 68. Orbiting scroll member 50 is prevented from rotating about its own axis by means of a conventional Oldham ring assembly, comprising an Oldham ring 88, and Oldham key pairs 90, 92 associated with orbiting scroll member 50 and frame member 52, respectively.

In operation of compressor 10 of the preferred embodiment, refrigerant fluid at suction pressure is introduced through suction pipe 94, which is received within a counterbore 96 in top cover plate 14 and is attached thereto as by silver soldering or brazing. A suction pressure chamber 98 is generally defined by fixed scroll member 48 and frame member 52. Refrigerant is introduced into chamber 98 from suction tube 94 through a suction passageway 100 defined by aligned holes in top cover plate 14 and fixed scroll member 48. As orbiting scroll member 50 is caused to orbit, refrigerant fluid within suction pressure chamber 98 is compressed radially inwardly by moving closed pockets defined by fixed wrap 64 and orbiting wrap 68.

Refrigerant fluid at discharge pressure in the innermost pocket between the wraps is discharged upwardly through a discharge port 102 communicating through face plate 62 of fixed scroll member 48. Compressed refrigerant discharged through port 102 enters a discharge plenum chamber 104 defined by the underside of top cover plate 14. A radially extending duct 106 formed in top cover plate 14 and an axially extending duct 108 extending along the side of fixed scroll member 48 and frame member 52 allow the compressed refrigerant in discharge plenum chamber 104 to be introduced into housing chamber 110 defined within housing 12. As shown in FIG. 2, a discharge tube 112 extends through central portion 16 of housing 12 and is sealed thereat as by silver solder 114. Discharge tube 112 allows pressurized refrigerant within housing chamber 110 to be delivered to the refrigeration system (not shown) in which compressor 10 is incorporated.

Figure 4:
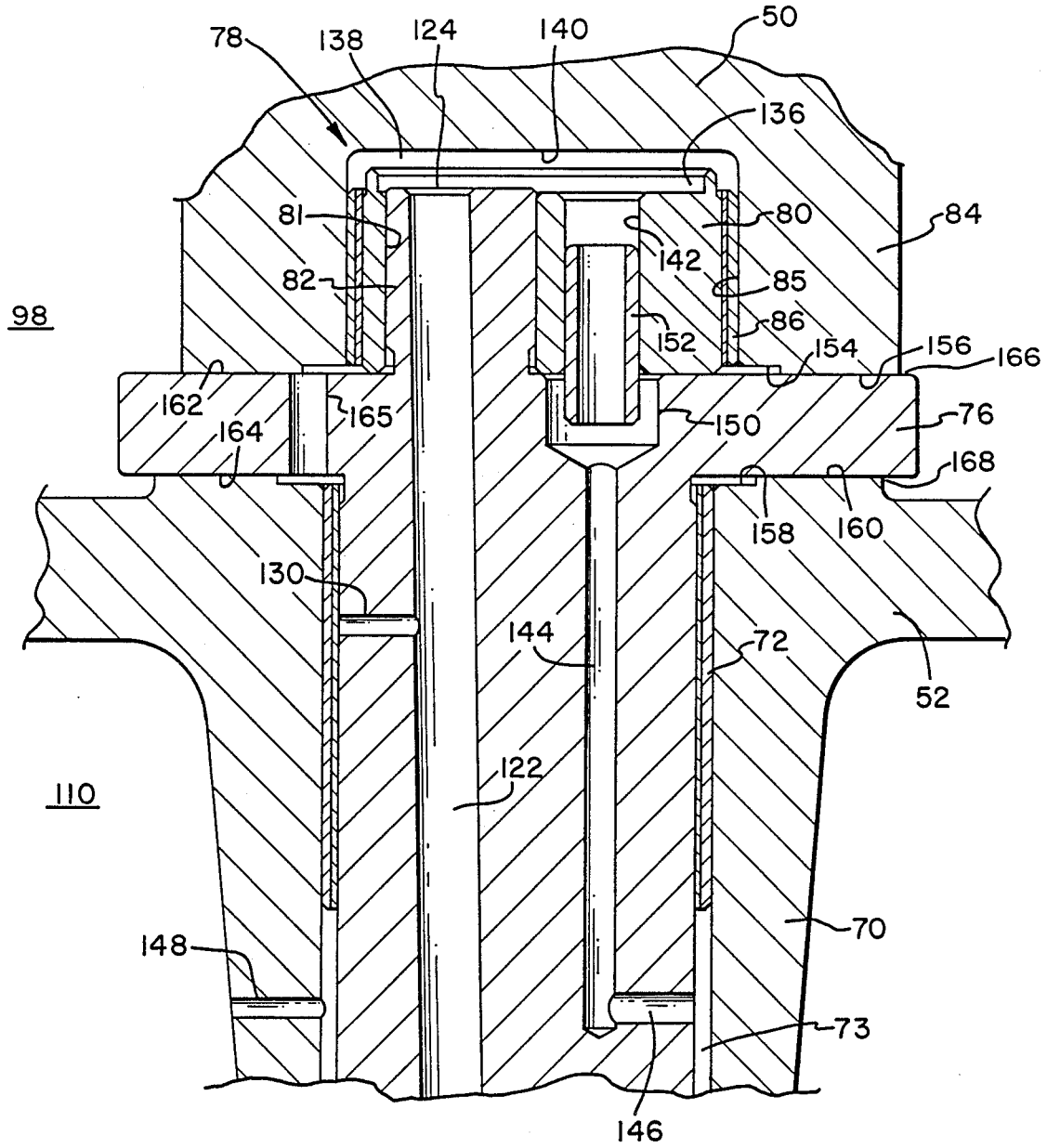
FIG. 4 is an enlarged fragmentary sectional view of the compressor of FIG. 1, according to one embodiment of the present invention.

Reference will now be made to FIGS. 1, 2, and 4 for a general discussion of the lubrication system of compressor 10. An axial oil passageway 120 is provided in crankshaft 32, which communicates with tube 38 and extends upwardly along the central axis of crankshaft 32. At a central location along the length of crankshaft 32, an offset, radially divergent oil passageway 122 intersects passageway 120 and extends to an opening 124 on the top of eccentric crankpin 82 at the top of crankshaft 32. As crankshaft 32 rotates, oil pickup tube 38 draws lubricating oil from oil sump 36 and causes oil to move upwardly trough oil passageways 120 and 122. As shown in FIGS. 1 and 2, lubrication of upper bearing 72 and lower bearing 74 is accomplished by means of flats 126 and 128 in crankshaft 32, located in the general vicinity of bearings 72 and 74, respectively. Flat 126 communicates with offset oil passageway 122 by means of a radial passage 130, while flat 128 communicates with axial oil passageway 120 by means of a radial passage 132. As illustrated in FIGS. 1 and 2, flats 126 and 128 extend axially along the length of crankshaft 32, and are located relative to bearings 72 and 74 so as to overlap and communicate with annular space 73.

Referring now to FIG. 4, lubricating oil pumped upwardly through offset oil passageway 122 exits crankshaft 32 through opening 124 located on the top of eccentric crankpin 82. A counterbore 136 in the top surface of roller 80 provides a reservoir into which oil from hole 124 is introduced. Lubricating oil within counterbore 136 will tend to flow downwardly along the interface between bore 81 and crankpin 82 for lubrication thereof. A flat on crankpin 82 (not shown) may be provided to enhance lubrication.

Lubrication delivered from hole 124 not only fills counterbore 136, but also fills a chamber 138 within well 85, defined by bottom surface 140 of well 85 and the top surface of crank mechanism 78, including roller 80 and crankpin 82. Oil within chamber 138 tends to flow downwardly along the interface between roller 80 and sleeve bearing 86 for lubrication thereof. A flat (not shown) may be provided in the outer cylindrical surface of roller 80 to enhance lubrication.

The lubrication system of compressor 10 further includes a vent for returning the oil that is pumped from sump 36 to counterbore 136 and chamber 138, back to sump 36. Specifically, an axially extending vent bore 142 is provided in roller 80, which provides communication between the top and bottom surfaces thereof. An axial vent passageway 144 extends axially through crankshaft 32 from the top surface of thrust plate 76 to a location along the length of crankshaft 32 adjacent annular space 73. A radial vent passageway 146 extends radially from axial passageway 144 to an outer surface of crankshaft 32 partially defining annular space 73. Furthermore, a vent hole 148 is provided through bearing portion 70 to provide communication between annular space 73 and housing chamber 110.

During venting of the lubrication system of compressor 10, lubricating oil is pumped upwardly through axial oil passageway 120 and offset oil passageway 122 by the operation of centrifugal oil pick-up tube 38. Upon leaving passageway 122 through opening 124, the oil collects in counterbore 136 and chamber 138 and is also vented downwardly through vent bore 142. Vent bore 142 is generally aligned with the upper portion of axial vent passageway 144 at the interface between roller 80 and thrust plate 76. Therefore, oil flowing downwardly through vent bore 142 continues to flow through vent passageway 144, and then radially outwardly into annular space 73 through radial vent passageway 146. Oil contained within annular space 73, whether deposited there as the result of venting or as the result of the previously described lubrication of bearing 72 and 74, is metered back into housing chamber 110 through vent hole 148.

As discussed previously with respect to the swing-link radial compliance mechanism of the preferred embodiment, roller 80 pivots slightly with respect to crankpin 82 to effect radial compliance of orbiting scroll member 50 against fixed scroll member 48. Accordingly, in order to maintain generally aligned communication between vent bore 142 and axial vent passageway 144, the upper portion of passageway 144 adjacent the top surface of thrust plate 76 comprises a pocket 150 having a diameter greater than that of vent bore 142. In this manner, roller 80 may experience limited pivotal motion while maintaining fluid communication between vent bore 142 and axial vent passageway 144. As shown in FIG. 4, a hollow roll pin 152 is press fit into vent bore 142 and extends from the bottom of roller 80 into the void defined by pocket 150. Oil may continue to flow through roll pin 152 to maintain fluid communication between vent bore 142 and axial passageway 144, however, roller 80 is restrained from pivoting completely about crankpin 82. This restraint against pivoting is used primarily during assembly to keep roller 80 within a range of positions to ensure easy assembly of orbiting scroll member 50 and fixed scroll member 48.

Referring now to FIG. 4 for a description of the axial compliance mechanism of compressor 10, lubricating oil at discharge pressure is provided by the aforementioned lubrication system to the underside of orbiting scroll member 50 within well 85 thereof. More specifically, when the lubricating oil fills chamber 138, an upward force acts upon orbiting scroll member 50 toward fixed scroll member 48. The magnitude of the upward force is determined by the surface area of bottom surface 140. In order to increase the upward force on orbiting scroll member 50, a shallow counterbore 154 is provided in a bottom surface 156 of orbiting scroll member 50 immediately adjacent, i.e., circumjacent, the opening of well 85. Counterbore 154 provides additional surface area on bottom surface 156 to which lubricating oil at discharge pressure may be exposed to create an upward force on orbiting scroll member 50.

In order to keep the forces acting on crankshaft 32 essentially at equilibrium, i.e., exposing the top and bottom of the crankshaft to the same pressures, a counterbore 158 is provided in a top surface 160 of main bearing frame member 52 immediately adjacent, i.e., circumjacent, the opening of bearing portion 70. In this manner, equal areas of a top surface 162 and a bottom surface 164 of thrust plate 76 are exposed to the lubricating oil at discharge pressure within counterbore 154 and counterbore 158, respectively. Additionally, a pressure equalization port 165 may be provided in thrust plate 76 to insure that the oil within counterbores 154 and 158 is at the same pressure. Port 165 extends between top surface 162 and bottom surface 164 and provides communication between counterbores 154 and 158.

In one embodiment of compressor 10, particularly shown in FIG. 4, the lubricating oil at discharge pressure within counterbores 154, 158 is sealingly separated from suction pressure chamber 98, located radially outwardly therefrom, by slightly leaky hydrodynamic seals comprising top interface 166 defined by closely spaced top surface 162 and bottom surface 156, and bottom interface 168 defined by closely spaced bottom surface 164 and top surface 160, respectively. In order to achieve the desired hydrodynamic seal, the respective top and bottom surfaces should be machined flat and the clearance within interfaces 166 and 168 should be maintained between 0.0001 and 0.0005 inches. Alternatively, an annular seal element may be disposed within each of the interfaces 166 and 168, thereby permitting greater clearances within the interfaces.

Reference will now be made to FIGS. 5–11 for an alternative embodiment of the present invention wherein annular seal elements are provided within top interface 166 and bottom interface 168. The scroll-type compressor of the alternative embodiment is identical to compressor 10 of FIGS. 1–4, with the exception that orbiting scroll member 50′ and main bearing frame member 52′ of the alternative embodiment have been modified to accommodate annular seal elements. Accordingly, identical reference numerals are used in FIGS. 5–11 to designate components previously described with respect to FIGS. 1–4. Additional reference numerals will be used to describe structure specific to the alternative embodiment of FIGS. 5–11.

Figure 5:
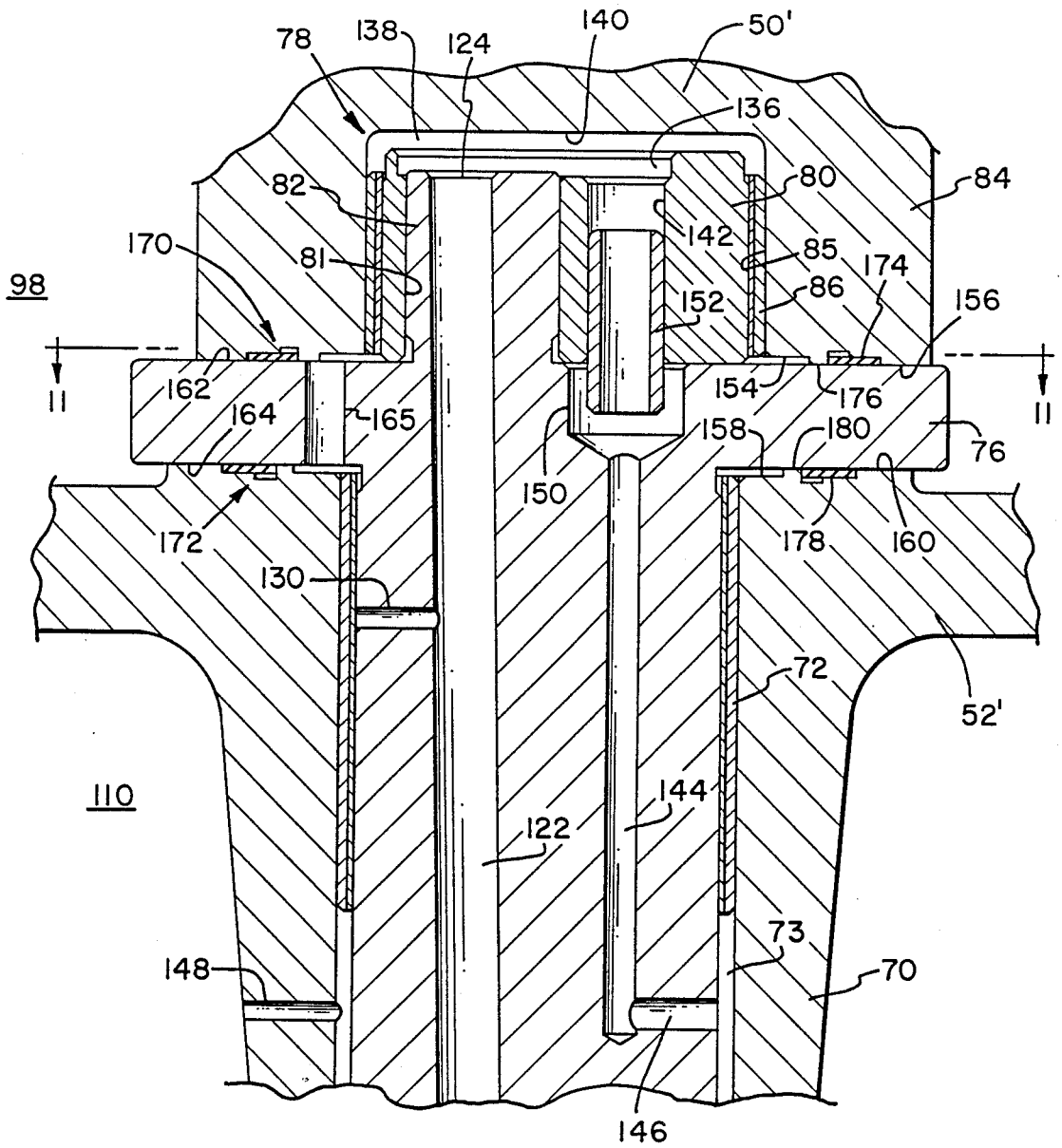
FIG. 5 is an enlarged fragmentary sectional view of a scroll-type compressor similar to the compressor of FIG. 1, according to an alternative embodiment of the present invention wherein an annular seal element is employed, the reference numerals used in FIGS. 5–11 being identical to those used in FIGS. 1–4 in the case of identical components, and being primed in those instances where a component has been modified in accordance with the alternative embodiment.
Figure 6:
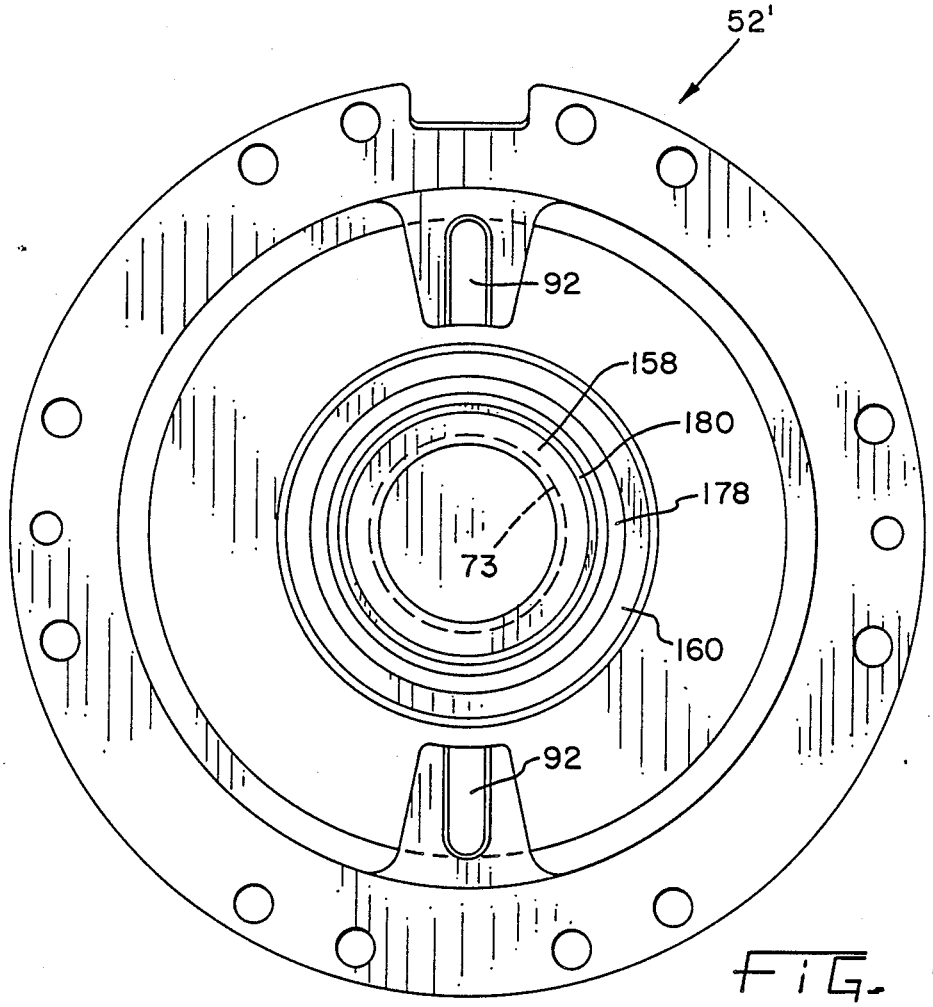
FIG. 6 is an enlarged top view of the main bearing frame member of the compressor of FIG. 5.
Figure 7:
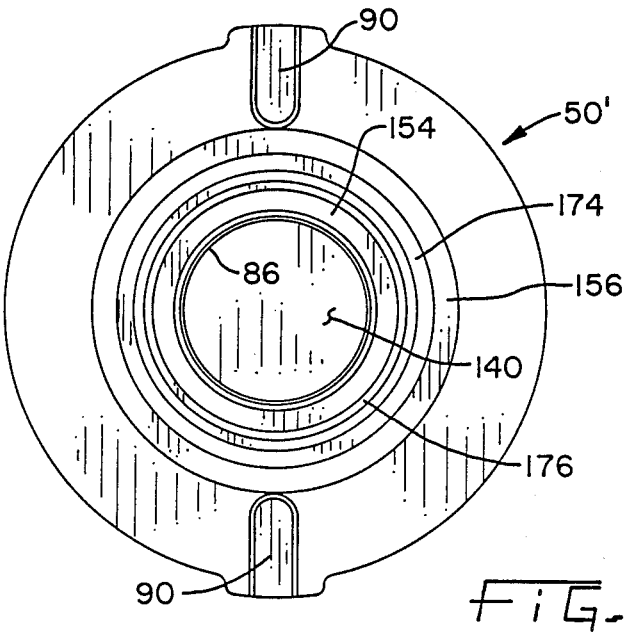
FIG. 7 is an enlarged bottom view of the orbiting scroll member of the compressor of FIG. 5.

Referring now to FIG. 5, a top seal assembly 170 and a bottom seal assembly 172 are provided within top interface 166 and bottom interface 168, respectively, to substantially seal between counterbores 154 and 158 containing oil at discharge pressure, and suction pressure chamber 98 located radially outwardly of top and bottom interfaces 166 and 168. As shown in FIGS. 5 and 7, orbiting scroll member 50′ includes an annular stepped seal groove 174 formed within bottom surface 156, as by milling. An annular land 176 is radially disposed between counterbore 154 and stepped seal groove 174. Similarly, a stepped seal groove 178 is formed in top surface 160 of frame member 52, as shown in FIGS. 5 and 6. An annular land portion 180 is radially disposed between counterbore 158 and seal groove 178.

Figure 8:
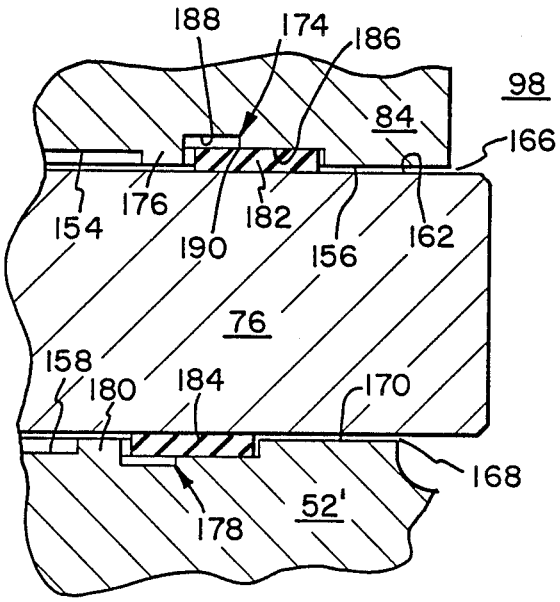
FIG. 8 is an enlarged fragmentary sectional view of the compressor of FIG. 5, particularly showing the annular seal element in a non-actuated state.
Figure 9:
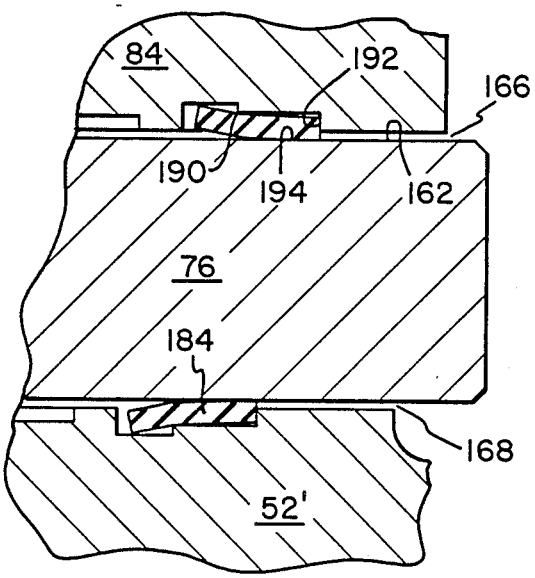
FIG. 9 is an enlarged fragmentary sectional view of the compressor of FIG. 5, particularly showing the annular seal element in an actuated state.

Referring now to FIGS. 8 and 9, an annular seal element 182 is disposed within top seal groove 174, and an annular seal element 184 is disposed within bottom seal groove 178 Reference will now be made to top seal groove 174 and annular seal element 182 for a detailed description of top seal assembly 170. The foregoing discussion is equally applicable to bottom seal assembly 172, which is a mirror image of top seal assembly 170.

Referring once again to FIGS. 8 and 9, top seal groove 174 includes a shallow channel portion 186, a deep channel portion 188, and a ledge portion 190 disposed therebetween. When compressor 10 is assembled and at rest, seal element 182 is in a flat non-actuated state, as shown in FIG. 8. However, when compressor 10 starts, lubricating oil at discharge pressure within counterbore 154 begins moving radially outwardly within top interface 166. Initially, the oil flows radially outwardly around both the top and bottom surfaces of seal element 182. Seal 182 is flexingly actuated when the channeling effect of the oil flow between seal element 182 and seal groove 174 causes seal element 182 to be forced there against. Furthermore, the radially innermost portion of seal element 182 continues to move into deep channel portion 188, thereby causing seal element 182 to pivot about ledge portion 190, as shown in FIG. 9. At the same time, seal element 182, due to the pressure differential between the oil at discharge pressure within counterbore 154 and suction pressure chamber 98, is forced radially outwardly along top interface 166. Accordingly, as shown in FIG. 9, the primary points of sealing contact for seal element 182 are the pivot point at ledge 190, a radially outermost sidewall 192 of seal groove 174, and an annular seal contacting region 194 of top surface 162 of thrust plate 76.

Figure 10:
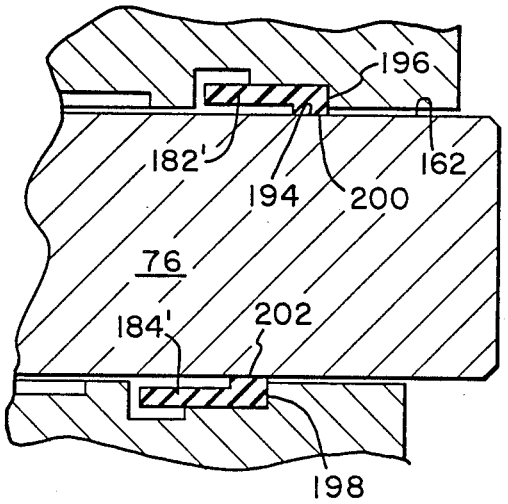
FIG. 10 is an enlarged fragmentary sectional view of the compressor of FIG. 5, particularly showing an alternative embodiment of the annular seal element.

FIG. 10 illustrates an alternative embodiment of annular seal elements 182 and 184, wherein seal elements 182′ and 184′ include an L-shaped cross-sectional configuration. More specifically, respective axial projections 196 and 198 provide seals 182′ and 184′ with contacting surfaces 200 and 202, respectively. The operation of seal elements 182′ and 184′ is similar to that of seal elements 182 and 184 already described. However, the provision of contacting surfaces 200 and 202 allows the total contacting area of annular seal contacting region to be less than that experienced with flat sealing elements 182 and 184. Accordingly, lower friction is experienced during operation of the compressor according to the alternative embodiment of the annular seal elements, as shown in FIG. 10.

Figure 11:
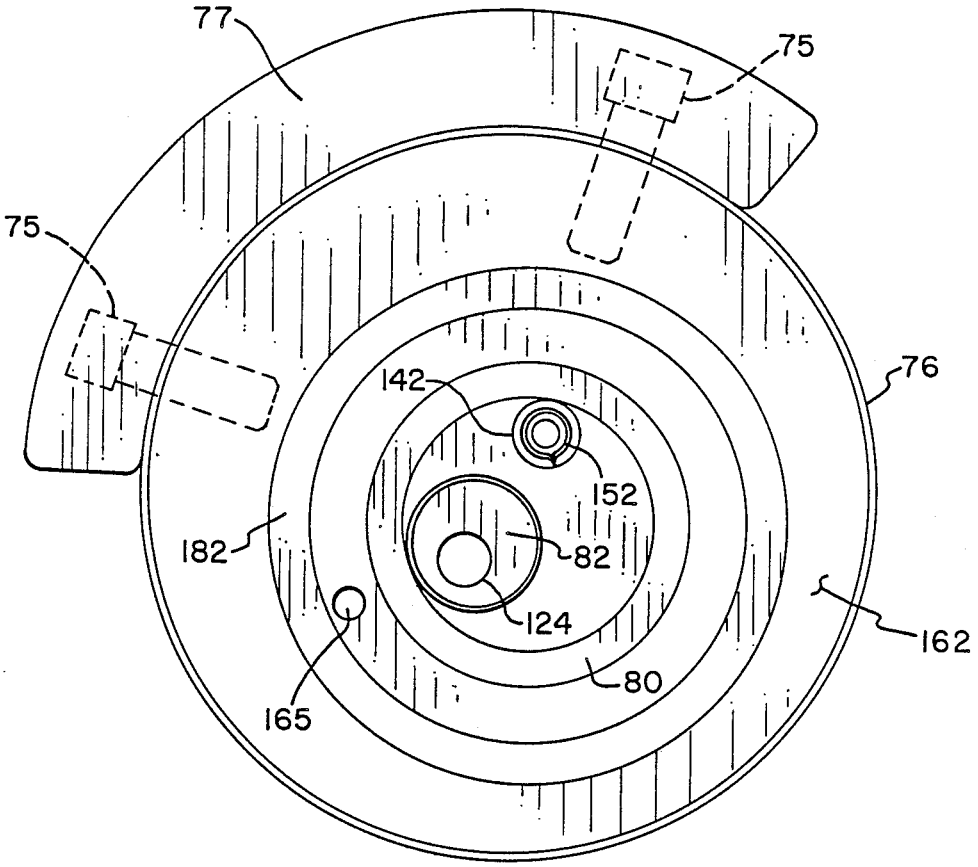
FIG. 11 is an enlarged fragmentary sectional view of the compressor of FIG. 5, taken along the line 11—11 in FIG. 5 and viewed in the direction of the arrows, particularly showing the location of the top annular seal on the top surface of the crankshaft thrust plate.

FIG. 11 illustrates the concentric orientation of annular seal element 182 on top surface 162 of thrust plate 76, with respect to roller 80. More specifically, pressure equalization port 165 is shown radially positioned between annular seal element 184 and roller 80, so as to retain lubricating oil at discharge pressure radially inward from top seal assembly 170.

The annular seal elements disclosed herein are preferably composed of a Teflon material. More specifically, a glass-filled Teflon, or a mixture of Teflon, Carbon, and Ryton is preferred in order to provide the seal element with the necessary rigidity to resist extruding into clearances due to pressure differentials. Furthermore, the surfaces against which the Teflon seals contact are preferably bronze.

It will be appreciated that the foregoing description of various embodiments of the invention is presented by way of illustration only and not by way of any limitation, and that various alternatives and modifications may be made to the illustrated embodiments without departing from the spirit and scope of the invention.

What is claimed is:

1. A scroll-type compressor for compressing refrigerant fluid, comprising:

a hermetically sealed housing including therein a discharge pressure chamber at discharge pressure and a suction pressure chamber at suction pressure;

an oil sump within said discharge pressure chamber;

suction inlet means for conveying refrigerant from outside of said housing to said suction pressure chamber;

discharge outlet means for conveying refrigerant from said discharge pressure chamber to outside of said housing;

a fixed scroll member within said housing including an involute fixed wrap element;

an orbiting scroll member having a top surface and a bottom surface, said orbiting scroll member including an involute orbiting wrap element on said top surface, said fixed and orbiting scroll members being generally axially aligned and having an interface therebetween whereat said fixed and orbiting wraps are intermeshed, a radially outer portion of said interface communicating with said suction pressure chamber and a radially inner portion of said interface communicating with said discharge pressure chamber, said orbiting scroll member being adapted to orbit with respect to said fixed scroll member such that refrigerant entering said interface at said radially outer portion is compressed and subsequently discharged at said radially inner portion;

drive means for causing said orbiting scroll to orbit;

axial compliance means for applying a net axial force on said bottom surface of said orbiting scroll member toward said fixed scroll member, said compliance means comprising means for exposing a radially outer portion of said bottom surface to said suction pressure chamber and a radially inner portion of said bottom surface to oil from said oil sump, said oil from said oil sump being at substantially discharge pressure; and seal means for substantially sealing between said radially outer portion exposed to said suction pressure chamber and said radially inner portion exposed to said oil from said oil sump, whereby said seal means establishes an interface between a radially inner, oil-filled chamber and a radially outer gaseous chamber.

2. The compressor of claim 1 in which:

said drive means includes a rotatable crankshaft having a radially extending thrust plate and an eccentric crank portion extending upwardly from a top surface of said thrust plate, said crank portion operatively engaging said orbiting scroll member to impart orbiting motion thereto; and said seal means includes a hydrodynamic oil seal comprising respective seal surfaces on said orbiting scroll member bottom surface and on said thrust plate top surface, said seal surfaces being radially located intermediate said respective portions of said orbiting scroll member exposed to said suction pressure chamber and to said oil from said oil sump, said respective seal surfaces being generally axially aligned and closely spaced so as to limit flow of oil from said radially inner portion exposed to said oil to said radially outer portion exposed to said suction pressure chamber.

3. The compressor of claim 1 in which:

said drive means includes a rotatable crankshaft having a radially extending thrust plate and an eccentric crank portion extending upwardly from a top surface of said thrust plate, said crank portion operatively engaging said orbiting scroll member to impart orbiting motion thereto; and said seal means comprises an annular seal ring located between said orbiting scroll member bottom surface and said thrust plate top surface, said seal ring being radially located intermediate said respective portions of said orbiting scroll member exposed to said suction pressure chamber and to said oil from said oil sump, whereby said seal means limits flow of oil from said radially inner portion exposed to said radially outer oil to said portion exposed to said suction pressure chamber.

4. The compressor of claim 1 in which:

said drive means comprises a rotatable crankshaft having a lower pump end disposed within said oil sump and an upper delivery end adjacent said orbiting scroll member bottom surface, said crankshaft including an axial oil passageway extending from said lower pump end to said upper delivery end for delivering said oil from said oil sump to said orbiting scroll member bottom surface for exposure thereto.

5. The compressor of claim 4 in which:

said lower pump end of said crankshaft comprises a centrifugal oil pump operable upon rotation of said crankshaft.

6. A hermetic scroll-type compressor, comprising:

a hermetically sealed housing including a discharge pressure chamber having an oil sump located therein;

a fixed scroll member within said housing, said fixed scroll member including an involute fixed wrap element;

an orbiting scroll member including an involute orbiting wrap element on a top surface thereof, said fixed and orbiting scroll members being intermeshed to define one or more pockets of fluid compressed by relative orbital motion of the said fixed and orbiting scroll members, said orbiting scroll member having a bottom surface including a well formed therein;

driving means coupled to said orbiting scroll member, for causing said orbiting scroll member to move in orbital relationship relative to said fixed scroll member, said driving means comprising a crankshaft, said crankshaft having an eccentric crank portion, a shaft portion, and a radially extending plate portion between said crank portion and said shaft portion, said crank portion extending upwardly from a top surface of said plate portion and being journalled for rotation within said well such that said bottom surface of said orbiting scroll member and said top surface of said plate portion meet at a substantially planar interface therebetween, said interface originating adjacent said crank portion and extending radially outwardly therefrom; and oil chamber means for exposing an area on said orbiting scroll member bottom surface within said interface, to oil from said oil sump, said oil chamber means comprising a channel within said interface, said channel originating at a radially innermost portion of said interface and extending radially outwardly therefrom and terminating at an intermediate radial location within said interface, said channel providing axial space between said orbiting scroll member bottom surface and said plate portion top surface; and means for supplying oil from said oil sump to said oil chamber means.

7. The compressor of claim 6 in which:

said channel is formed in said orbiting scroll member bottom surface and comprises an annular counterbore in said bottom surface located circumjacent said well.

8. The compressor of claim 7, and further comprising:

seal means radially outwardly of said annular counterbore for preventing oil from within said channel from excessively leaking radially outwardly beyond said interface.

9. The compressor of claim 8 in which:

said seal means includes a hydrodynamic oil seal comprising respective seal surfaces on said orbiting scroll member bottom surface and on said plate portion top surface, said seal surfaces being located radially outwardly from said channel, said respective seal surfaces being generally axially aligned and closely spaced so as to limit leakage of oil from said channel portion radially outwardly beyond said interface.

10. The compressor of claim 8 in which:

said seal means comprises an annular seal ring located between said orbiting scroll member bottom surface and said plate portion top surface, said seal ring being located radially outwardly from said channel, whereby said seal means limits leakage of oil from said channel radially outwardly beyond said interface.

11. The compressor of claim 6 in which:

said crankshaft has a lower pump end disposed within said oil sump, and includes an axial oil passageway extending along the length thereof, said lower pump end comprising a centrifugal oil pump operable upon rotation of said crankshaft to pump oil from said oil sump upwardly through said axial oil passageway; and said means for supplying oil from said oil sump to said oil chamber means comprises said oil pump and said axial oil passageway.

12. The compressor of claim 11 in which:

said axial oil passageway extends from said oil pump end to an opening on said crank portion within said well;

said channel is in fluid communication with said well; and said means for supplying oil from said oil sump to said oil chamber means comprises said oil pump, said axial oil passageway, and said opening on said crank portion.

13. The compressor of claim 6 in which:

said crank portion of said crankshaft comprises an eccentric crankpin extending upwardly from said plate portion, and a cylindrical roller eccentrically journalled about said crankpin.

14. A scroll-type compressor for compressing refrigerant, comprising:

a hermetically sealed housing including therein a discharge pressure chamber;

an oil sump within said discharge pressure chamber;

discharge outlet means for conveying refrigerant from said discharge pressure chamber to outside of said housing;

a fixed scroll member mounted within said housing and having a bottom surface, said fixed scroll member bottom surface including an involute fixed wrap element;

an orbiting scroll member having a top face surface and a bottom surface, said orbiting scroll member top surface including an involute orbiting wrap element, said fixed and orbiting scroll members cooperatively engaging one another to form a plurality of pockets therebetween, said orbiting scroll member being adapted to orbit with respect to said fixed scroll member;

a frame connected within said housing to said fixed scroll member bottom surface, said frame including a suction pressure chamber in which said orbiting scroll member is disposed;

suction inlet means for conveying said refrigerant from outside of said housing to said suction pressure chamber;

a rotatable crankshaft having an eccentric crank portion, a shaft portion extending through said frame, and a radially extending plate portion between said crank portion and said shaft portion, said plate portion having a top surface and a bottom surface, said crank portion operatively engaging said orbiting scroll member bottom surface so as to cause said orbiting scroll member to experience orbiting motion, said orbiting scroll member bottom surface being adjacent said plate portion top surface to establish a top interface therebetween, and said plate portion bottom surface being adjacent a thrust surface of said frame to establish a bottom interface therebetween;

a top oil chamber located within said to interface and a bottom oil chamber located within said bottom interface, each of said top and bottom oil chamber comprising a respective channel within said respective interface, said respective channel originating at a radially innermost portion of said respective interface and extending radially outwardly therefrom and terminating at an intermediate radial location within said respective interface, said respective channel providing axial space within said respective interface; and means for delivering oil from said oil sump to said top and bottom oil chambers.

15. The compressor of claim 16 in which;

said top oil chamber comprises an upward counterbore in said orbiting scroll member bottom surface and said bottom oil chamber comprises a downward counterbore in said thrust surface, said top and bottom counterbores extending axially away from said top and bottom interfaces, respectively.

16. The compressor of claim 15, and further comprising:

seal means disposed within said top and bottom interfaces located radially outwardly from said top and bottom counterbores, respectively.

17. The compressor of claim 14 in which:

said oil delivering means comprises an axial oil passageway extending through said crankshaft to provide fluid communication between said oil sump and said top and bottom oil chambers.

18. The compressor of claim 14 in which:

said top and bottom oil chambers are exposed to substantially equal surface areas on said plate portion top surface and said plate portion bottom surface, respectively.

* * * * *

UNITED STATES PATENT AND TRADEMARK OFFICE

CERTIFICATE OF CORRECTION

PATENT NO. : 4,875,838

DATED : October 24, 1989

INVENTOR(S) : Hubert Richardson

It is certified that error appears in the above-identified patent and that said Letters Patent is hereby corrected as shown below:

Col. 7, line 60, change "trough" to --through--;

Claim 15, Col. 15, line 3, change "Claim 16" to --Claim 14--.

Signed and Sealed this

Twenty-seventh Day of November, 1990

*Attest:*

HARRY F. MANBECK, JR.

*Attesting Officer*

*Commissioner of Patents and Trademarks*